US012038215B2

(12) United States Patent
Durand et al.

(10) Patent No.: US 12,038,215 B2
(45) Date of Patent: Jul. 16, 2024

(54) REFRIGERATION DEVICE AND SYSTEM

(71) Applicant: L'Air Liquide, Societe Anonyme pour l'Etude et l'Exploitation des Procedes Georges Claude, Paris (FR)

(72) Inventors: Fabien Durand, Sassenage (FR); Guillaume Delautre, Sassenage (FR)

(73) Assignee: L'Air Liquide, Societe Anonyme Pour L'Etude Et L'Exploitation Des Procedes, Georges Claude Paris (FR)

( * ) Notice: Subject to any disclaimer, the term of this patent is extended or adjusted under 35 U.S.C. 154(b) by 297 days.

(21) Appl. No.: 17/633,003

(22) PCT Filed: Jul. 8, 2020

(86) PCT No.: PCT/EP2020/069178
§ 371 (c)(1),
(2) Date: Feb. 4, 2022

(87) PCT Pub. No.: WO2021/023456
PCT Pub. Date: Feb. 11, 2021

(65) Prior Publication Data

US 2022/0282891 A1 Sep. 8, 2022

(30) Foreign Application Priority Data

Aug. 5, 2019 (FR) ..... 1908947

(51) Int. Cl.
*F25B 7/00* (2006.01)
*F25B 41/40* (2021.01)

(52) U.S. Cl.
CPC ..... *F25B 7/00* (2013.01); *F25B 41/40* (2021.01)

(58) Field of Classification Search
CPC .... F25B 7/00; F25B 1/053; F25B 1/10; F25B 11/04; F25B 31/026; F25B 40/00;
(Continued)

(56) References Cited

U.S. PATENT DOCUMENTS

2012/0291434 A1* 11/2012 Janssens ..... F28D 21/0001 417/372
2016/0076793 A1* 3/2016 Nakamura ..... F25B 6/04 62/402

(Continued)

FOREIGN PATENT DOCUMENTS

WO WO 2019/073129 4/2019

OTHER PUBLICATIONS

International Search Report and Written Report for PCT/EP2020/069178, mailed Oct. 16, 2020.

(Continued)

*Primary Examiner* — Len Tran
*Assistant Examiner* — Kamran Tavakoldavani
(74) *Attorney, Agent, or Firm* — Justin K. Murray

(57) ABSTRACT

Disclosed is a low-temperature refrigeration device comprising a working circuit that forms a loop and contains a working fluid the working circuit forming a cycle which includes, connected in series: a compression mechanism, a cooling mechanism, an expansion mechanism and a heating mechanism, the device further comprising a refrigeration heat exchanger for extracting heat from at least one member by exchanging heat with the working fluid flowing in the working circuit, the compression mechanism comprising two separate compressors, the mechanism for cooling the working fluid comprising two cooling heat exchangers which are arranged respectively at the outlet of the two compressors and ensure heat exchange between the working fluid and a cooling fluid, each cooling heat exchanger comprising a cooling fluid inlet and a cooling fluid outlet, characterized in that the cooling fluid outlet of one of the two cooling heat exchangers is connected to the cooling fluid inlet of the other cooling heat exchanger.

6 Claims, 3 Drawing Sheets

(58) Field of Classification Search
CPC ..... F25B 41/40; F25B 2339/047; F25B 2400/054; F25B 2400/072; F25B 2400/14; F25B 2500/01; F25B 2600/0251; F28D 7/0091; F28D 2021/0063
See application file for complete search history.

(56) References Cited

U.S. PATENT DOCUMENTS

| | | | | |
|---|---|---|---|---|
| 2017/0227260 | A1* | 8/2017 | Takayama | F25B 40/00 |
| 2018/0087809 | A1* | 3/2018 | Ueda | F25J 1/0284 |
| 2019/0301772 | A1* | 10/2019 | Zha | F25B 43/006 |
| 2020/0300510 | A1 | 9/2020 | Durand | |

OTHER PUBLICATIONS

French Search Report for FR 1 908 947, mailed Apr. 3, 2020.
"Brayton Closed Cycle Gas Turbine Study for LNG Reliquefaction System," Shipping World & Shipbuilder, vol. 166, No. 3887, Nov. 1, 1973, pp. 1199-1200.

* cited by examiner

[Fig. 1]
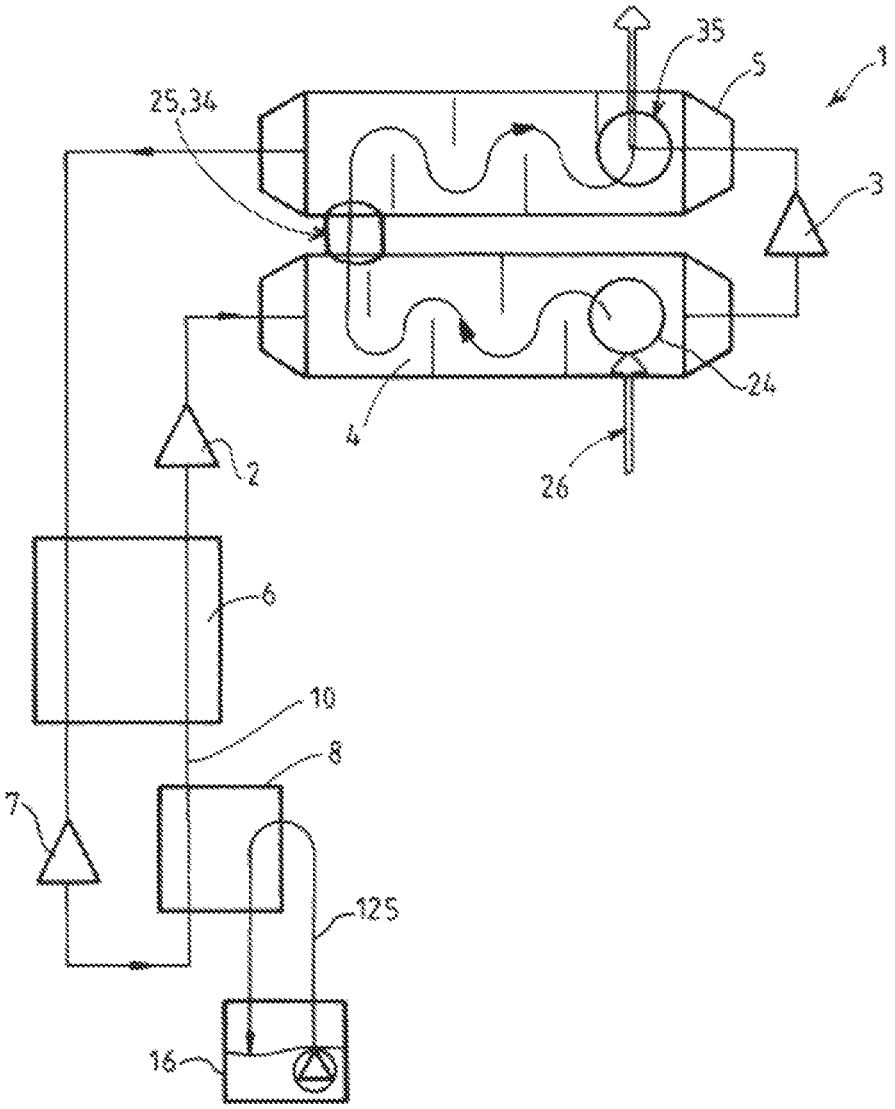

[Fig. 2]
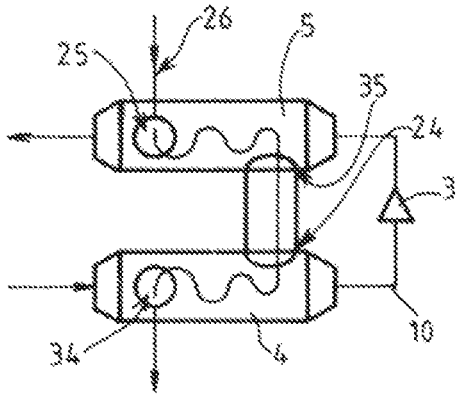
[Fig. 3]
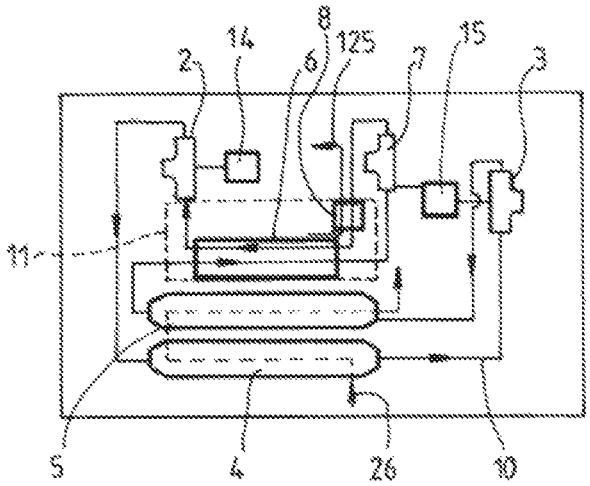

[Fig. 4]
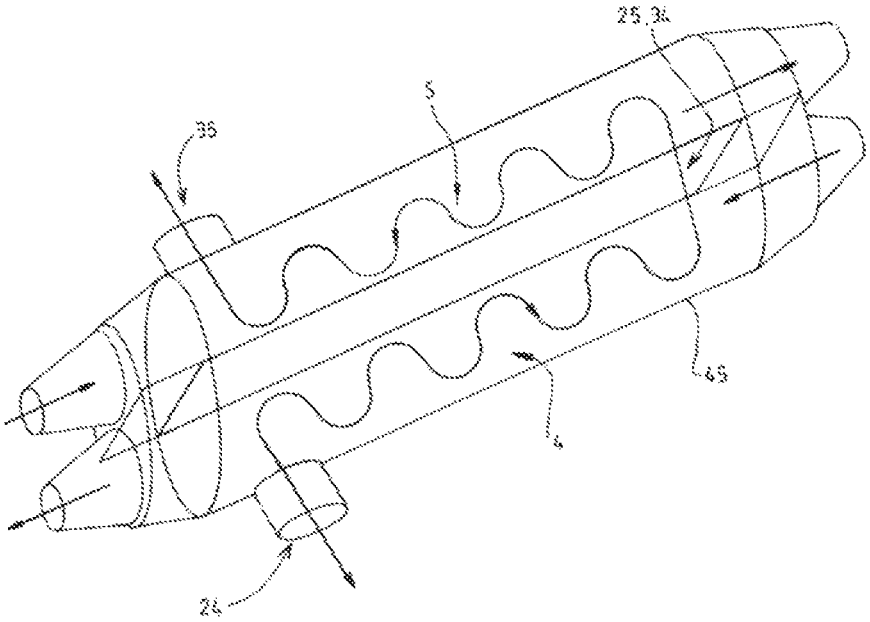

REFRIGERATION DEVICE AND SYSTEM

CROSS-REFERENCE TO RELATED APPLICATIONS

This application is a § 371 of International PCT Application PCT/EP2020/069178, filed Jul. 8, 2020, which claims § 119(a) foreign priority to French patent application FR 1908947, filed Aug. 5, 2019.

BACKGROUND

Field of the Invention

The invention relates to a device and a system for refrigeration.

The invention relates more particularly to a low-temperature refrigeration device, that is to say for refrigeration at a temperature of between minus 100 degrees centigrade and minus 273 degrees centigrade, and in particular between minus 100 degrees centigrade and minus 253 degrees centigrade, comprising a working circuit forming a loop and containing a working fluid, the working circuit forming a cycle that comprises, in series: a mechanism for compressing the working fluid, a mechanism for cooling the working fluid, a mechanism for expanding the working fluid, and a mechanism for heating the working fluid, the device comprising a refrigeration heat exchanger intended to extract heat at at least one member by heat exchange with the working fluid circulating in the working circuit, the compression mechanism comprising two separate compressors, the mechanism for cooling the working fluid comprising two cooling heat exchangers that are disposed respectively at the outlets of the two compressors and ensure heat exchange between the working fluid and a cooling fluid, each cooling heat exchanger comprising an inlet for cooling fluid and an outlet for cooling fluid.

The term low-temperature refrigeration device denotes a system for refrigeration at a temperature of between minus 100 degrees centigrade and minus 273 degrees centigrade, in particular between minus 100 degrees centigrade and minus 253 degrees centigrade.

The invention relates in particular to cryogenic refrigerators and/or liquefiers, for example of the type having a "Turbo Brayton" cycle or "Turbo Brayton coolers" in which a working gas, also known as a cycle gas (helium, nitrogen, hydrogen or another pure gas or a mixture), undergoes a thermodynamic cycle producing cold which can be transferred to a member or a gas intended to be cooled.

Related Art

These devices are used in a wide variety of applications and in particular for cooling the natural gas in a tank (for example in ships). The liquefied natural gas is for example subcooled to avoid vaporization thereof or the gaseous part is cooled in order to be reliquefied.

For example, a flow of natural gas can be made to circulate in a heat exchanger cooled by the cycle gas of the refrigerator/liquefier.

These devices may comprise a plurality of heat exchangers interposed at the outlets of the compression stages. These devices are incorporated in a surround or frame, the volume of which is limited. It is thus difficult to incorporate these various exchangers and associated pipes. The cooling of the working gas may be problematic in some cases.

SUMMARY OF THE INVENTION

An aim of the present invention is to overcome all or some of the disadvantages of the prior art identified above.

To this end, the device according to the invention, which is otherwise in accordance with the generic definition thereof given in the above preamble, is essentially characterized in that the outlet for cooling fluid of one of the two cooling heat exchangers is connected to the inlet for cooling fluid of the other cooling heat exchanger such that some of the flow of cooling fluid passing through one of the cooling heat exchangers has already circulated in the other cooling heat exchanger.

Furthermore, embodiments of the invention may include one or more of the following features:

- the two compressors are disposed in series in the working circuit,
- the coolant circuit supplies cooling fluid first of all to the first cooling heat exchanger in series in the direction of circulation of the working fluid, and then the second cooling heat exchanger in series in the direction of circulation of the working fluid is supplied with cooling fluid that has passed through the first cooling heat exchanger,
- the coolant circuit supplies cooling fluid first of all to the second cooling heat exchanger in series in the direction of circulation of the working fluid, the first cooling heat exchanger in series in the direction of circulation of the working fluid being supplied with cooling fluid that has passed through the second cooling heat exchanger,
- the two cooling heat exchangers each have an elongate shape extending in a respective longitudinal direction, each cooling heat exchanger comprising an inlet for working gas to be cooled and an outlet for cooled working gas that are disposed respectively at two longitudinal ends, the two cooling heat exchangers being arranged inversely with respect to one another, meaning that the respective longitudinal directions of the two cooling heat exchangers are parallel or substantially parallel and the directions of circulation of the working fluid in said cooling heat exchangers are opposite to one another,
- the two cooling heat exchangers are situated adjacently, that is to say in a manner spaced apart by a distance of between zero and 500 mm, in particular between 100 and 300 mm,
- the two cooling heat exchangers are incorporated in one and the same casing comprising two separate passages for the circulation of the working fluid, said two passages being in heat exchange respectively with two portions in series of one and the same circulation channel of the cooling fluid circuit.

The invention also relates to a system for refrigeration and/or liquefaction of a flow of user fluid, in particular natural gas, comprising such a refrigeration device, the system comprising at least one tank of user fluid, and a duct for circulation of said flow of user fluid in the cooling exchanger.

According to other possible particular features, the compression mechanism comprises two or more compressors and at least one drive motor for rotating the compressor(s) and comprising a rotary drive shaft, the compressors being driven in rotation by the respective rotary shaft(s), the mechanism for expanding the working fluid comprising at least one rotary turbine that rotates conjointly with a shaft of one of the drive motors of at least one compressor, the refrigeration capacity of the refrigeration device being variable and controlled by a controller that regulates the speed of rotation of the drive motor(s).

The invention may also relate to any alternative device or method comprising any combination of the features above or below within the scope of the claims.

BRIEF DESCRIPTION OF THE FIGURES

Further particular features and advantages will become apparent upon reading the following description, which is given with reference to the figures, in which:

FIG. 1 shows a schematic and partial view illustrating the structure and operation of an example of a device and a system that can implement the invention, FIG. 2 shows a schematic and partial view illustrating a detail of the structure and of the operation of the device and of the system according to one embodiment variant of the arrangement of two cooling heat exchangers, FIG. 3 shows a schematic and partial view illustrating the structure and operation of an example of a device and a system that can implement the invention, according to another exemplary embodiment, FIG. 4 shows a schematic and partial view illustrating a detail of the structure and of the operation of the device and of the system according to one possible embodiment variant of the arrangement of two cooling heat exchangers.

DETAILED DESCRIPTION OF THE INVENTION

The cooling and/or liquefaction system in [FIG. 1] or [FIG. 4] comprises a refrigeration device 1 that supplies cold (a cooling capacity) at a refrigeration heat exchanger 8.

The system comprises a duct 125 for circulation of a flow of fluid to be cooled placed in heat exchange with this cooling exchanger 8. For example, the fluid is liquid natural gas pumped from a tank 16 (for example via a pump), then cooled (preferably outside the tank 16), then returned to the tank 16 (for example raining down in the gas phase of the tank 16). This makes it possible to cool or subcool the contents of the tank 16 and to limit the occurrence of vaporization. For example, the liquid from the tank 16 is subcooled below its saturation temperature (drop in its temperature of several K, in particular 5 to 20K and in particular 14K) before being reinjected into the tank 16. In a variant, this refrigeration can be applied to the vaporization gas from the tank in order in particular to reliquefy it. This means that the refrigeration device 1 produces a cold capacity at the refrigeration heat exchanger 8.

The refrigeration device 1 comprises a working circuit 10 (preferably closed) forming a circulation loop. This working circuit 10 contains a working fluid (helium, nitrogen, neon, hydrogen) or another appropriate gas or mixture (for example helium and argon or helium and nitrogen or helium and neon or helium and nitrogen and neon).

The working circuit 10 forms a cycle comprising: a mechanism 2, 3 for compressing the working fluid, a mechanism 4, 5, 6 for cooling the working fluid, a mechanism 7 for expanding the working fluid, and a mechanism 6 for heating the working fluid.

The device 1 comprises a refrigeration heat exchanger 8 situated downstream of the expansion mechanism 7 and intended to extract heat at at least one member 25 by heat exchange with the cold working fluid circulating in the working circuit 10.

The mechanisms for cooling and heating the working fluid may conventionally comprise a common heat exchanger 6 through which the working fluid passes in countercurrent in two separate passage portions of the working circuit 10 depending on whether it is cooled or heated.

The cooling heat exchanger 8 is situated for example between the expansion mechanism 7 and the common heat exchanger 6. As illustrated, the cooling heat exchanger 8 may be a heat exchanger separate from the common heat exchanger 6. However, in a variant, this refrigeration heat exchanger 8 could be made up of a portion of the common heat exchanger 6 (meaning that the two exchangers 6, 8 can be in one piece, i.e. may have separate fluid circuits that share one and the same exchange structure).

Thus, the working fluid which leaves the compression mechanism 2, 3 in a relatively hot state is cooled in the common heat exchanger 6 before entering the expansion mechanism 7. The working fluid which leaves the expansion mechanism 7 and the cooling heat exchanger 8 in a relatively cold state is, for its part, heated in the common heat exchanger 6 before returning into the compression mechanism 2, 3 in order to start a new cycle.

The compression mechanism 2, 3 comprises at least two compressors and at least one drive motor 14, 15 for the compressors 2, 3. In addition, preferably, the refrigeration capacity of the device is variable and can be controlled by regulating the speed of rotation of the drive motor(s) 14, 15 (cycle speed). Preferably, the cold capacity produced by the device 1 can be adapted by 0 to 100% of a nominal or maximum capacity by changing the speed of rotation of the motor(s) 14, 15 between a zero speed of rotation and a maximum or nominal speed. Such an architecture makes it possible to maintain a high performance level over a wide operating range (for example 97% of nominal performance at 50% of the nominal cold capacity).

In the nonlimiting example shown, the refrigeration device 1 comprises two compressors 2, 3 in series. These two compressors 2, 3 may be driven respectively by two separate motors 14, 15. A turbine 7 may be coupled to the drive shaft of one 15 of the two motors. For example, a first motor 14 drives only one compressor 3 (motor-compressor) while the other motor 15 drives a compressor 2 and is coupled to a turbine 7 (motor-turbocompressor).

For example, the device 1 comprises two high-speed motors 14, 15 (for example 10 000 revolutions per minute or several tens of thousands of revolutions per minute) for respectively driving the compression stages 2, 3. The turbine 7 may be coupled to the motor 15 of one of the compression stages 2, 3, meaning that the device may have a turbine 7 forming the expansion mechanism which is coupled to the drive motor 15 of a compression stage (the first or the second).

Thus, the power of the turbine(s) 7 can advantageously be recovered and used to reduce the consumption of the motor (s). Thus, by increasing the speed of the motors (and thus the flow rate in the cycle of the working gas), the refrigeration capacity produced and thus the electrical consumption of the liquefier are increased (and vice versa). The compressors 2, 3 and turbine(s) 7 are preferably coupled directly to an output shaft of the motor in question (without a geared movement transmission mechanism).

The output shafts of the motors are preferably mounted on bearings of the magnetic type or of the dynamic gas type. The bearings are used to support the compressors and the turbines.

In the example depicted, the refrigeration device 1 comprises two compressors 2, 3 that form two compression stages and an expansion turbine 7. This means that the compression mechanism comprises two compressors 2, 3 in series, preferably of the centrifugal type, and the expansion mechanism comprises a single turbine 7, preferably a centripetal turbine. Of course, any other number and arrangement of compressor(s), turbine(s) and motor(s) may be envisioned, for example: three compressors driven respectively by three separate motors, the turbine being for example coupled to one end of the drive shaft of one of these motors, or three compressors and two turbines. Similarly, the device could comprise two compressors and two turbines or three compressors and two or three turbines, etc. Each motor may comprise a shaft, one end of which drives one or more wheels (turbine or compressor) and the other end of which is coupled to one or more wheels (turbine or compressor) or is not coupled to any wheel.

As illustrated, a cooling heat exchanger 4, 5 is provided at the outlet of two compressors 2, 3 (for example cooling by heat exchange with water at ambient temperature or any other cooling agent or fluid of a coolant circuit 26).

This makes it possible to realize isentropic or isothermal or substantially isothermal compression. Similarly, a heating exchanger may or may not be provided at the outlet of all or part of the expansion turbines 7 to realize isentropic or isothermal expansion. Also preferably, the heating and cooling of the working fluid are preferably isobaric, without this being limiting.

Each cooling heat exchanger 4, 5 comprises an inlet 24, 25 for cooling fluid and an outlet 34, 35 for cooling fluid. According to an advantageous particular feature, the outlet 34 for cooling fluid of one of the two cooling heat exchangers 4, 5 is connected to the inlet 25 for cooling fluid of the other cooling heat exchanger 5 such that some of the flow of cooling fluid passing through one 5 of the cooling heat exchangers has already circulated in the other cooling heat exchanger 4.

This allows the two cooling heat exchangers 4, 5 to receive 100% of a flow of cooling fluid (rather than subdividing this flow into two halves distributed respectively in the two exchangers 4, 5).

Preferably, the cooling fluid effects only one passage through each cooling heat exchanger 4, 5. This means that when the cooling fluid has effected one passage and has exchanged with the working fluid, it does not return after having effected for example another exchange in another cooling heat exchanger.

For example, preferably, each cooling heat exchanger 4, 5 comprises a single inlet 24, 25 for cooling fluid and an outlet 34, 35 for cooling fluid (thus allowing only one passage through said cooling heat exchanger at a given temperature, meaning that there are not several simultaneous passages of the cooling fluid through the cooling heat exchanger at different temperatures or under different thermodynamic conditions).

In particular, when the cooling fluid has passed through each of the cooling heat exchangers, it does not pass through one or the other of the exchangers again.

Preferably, this is the case for all the cooling heat exchangers 4, 5. This also improves the effectiveness of cooling and of the device as a whole.

This relative increase in the cooling fluid flow rate thus makes it possible to increase the coefficient of heat exchange and therefore improves the quality and the reliability of cooling. Moreover, this solution makes it possible to avoid problems inherent to the known solution in which two flow rates can diverge within the two heat exchangers (on account in particular of pressure drops which may vary from one circuit or exchanger to the other).

As explained in more detail below, this arrangement also makes it possible to simplify the network of ducts for cooling fluid and working gas heading toward the heat exchangers 4, 5 or coming from the heat exchangers 4, 5. In particular, this arrangement makes it more easily possible to arrange the circulation circuits for the fluids (cooling fluid and working fluid) in a smaller space while allowing countercurrent circulations between the working fluid and the cooling fluid, by reducing the number and/or the length of the ducts transporting these fluids.

As shown in [FIG. 1], for example the coolant circuit 26 supplies cooling fluid first of all to the first cooling heat exchanger 4 and then to the second cooling heat exchanger 5 (the qualifiers "first" and "second" referring to the first and second compression stages in the direction of circulation of the working fluid).

Of course, as shown in [FIG. 2], the opposite arrangement may be envisioned (circulation of the cooling fluid first of all in the second heat exchanger 5 and then in the first heat exchanger 4).

As illustrated, in both cases, the directions of circulation of the two fluids (working fluid to be cooled and relatively colder cooling fluid) pass preferably in countercurrent or in opposite directions through each exchanger.

As illustrated in the figures [FIG. 1] and [FIG. 2], the fluidic connection between the two cooling heat exchangers 4, 5 for the passage of the cooling fluid may be simplified and smaller. This transfer of cooling fluid from one cooling exchanger 4, 5 to the other may in particular be realized by a short and welded portion of tube, or a simple tube or connector between the two heat exchangers 4, 5.

The two cooling heat exchangers 4, 5 may in particular be disposed adjacently, in particular alongside one another. This optimizes the space requirement of the device. For example, the two exchangers 4, 5 are side by side in a horizontal plane or one above the other in a vertical plane.

As illustrated in [FIG. 4], the two cooling heat exchangers 4, 5 may even be incorporated in one and the same casing 45 or housing comprising two separate passages for the circulation of the working fluid, said two passages being in heat exchange respectively with two portions in series of one and the same circulation channel of the cooling fluid circuit.

For example, and as illustrated, the cooling heat exchangers 4, 5 may each have an elongate shape extending in a respective longitudinal direction. Each cooling heat exchanger 4, 5 comprises an inlet for working gas to be cooled and an outlet for cooled working gas that are disposed respectively at two longitudinal ends.

The cooling heat exchangers 4, 5 may be exchangers of the tube type, of the shell and tube type, of the plate and fin type or any other appropriate technology. The exchangers may be made of stainless steel, aluminum or any other appropriate material(s).

The two cooling heat exchangers 4, 5 are arranged within the device preferably inversely with respect to one another, meaning that the respective longitudinal directions of the two cooling heat exchangers 4, 5 are parallel or substantially parallel and the directions of circulation of the working fluid in said cooling heat exchangers 4, 5 are opposite to one another. This arrangement combined with the arrangement of the circulation of the cooling fluid makes it possible to minimize the complexity of the fluidic circuits while conferring very good performance on the device.

All or part of the device, in particular the cold members thereof, can be accommodated in a thermally insulated sealed casing 11 (in particular a vacuum chamber containing the common countercurrent heat exchanger and the refrigeration exchanger 8).

As illustrated, the device may have only two compressors and two cooling heat exchangers.

The invention may apply to a method for cooling and/or liquefying another fluid or mixture, in particular hydrogen.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context dearly dictates otherwise.

"Comprising" in a claim is an open transitional term which means the subsequently identified claim elements are a nonexclusive listing i.e. anything else may be additionally included and remain within the scope of "comprising," "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the so other particular value, along with all combinations within said range.

All references identified herein are each hereby incorporated by reference into this application in their entireties, as well as for the specific information for which each is cited.

What is claimed is:

1. A low-temperature refrigeration device for refrigeration at a temperature of between minus 100 degrees centigrade and minus 273 degrees centigrade, comprising a working circuit and a refrigeration heat exchanger, wherein:

the working circuit forms a loop and contains a working fluid;

the working circuit forms a cycle that comprises, in series: a compression mechanism for compressing the working fluid, a cooling mechanism for cooling the working fluid, an expanding mechanism for expanding the working fluid, and a heating mechanism for heating the working fluid;

the compression mechanism comprises two separate compressors;

the cooling mechanism comprises two cooling heat exchangers that are disposed respectively at the outlets of the two compressors and ensure heat exchange between the working fluid and a cooling fluid;

each cooling heat exchanger comprises an inlet for cooling fluid and an outlet for cooling fluid;

the outlet for cooling fluid of one of the two cooling heat exchangers is connected to the inlet for cooling fluid of the other cooling heat exchanger such that the flow of cooling fluid passing through one of the cooling heat exchangers has already circulated in the other cooling heat exchanger;

the two compressors are disposed in series in the working circuit;

the refrigeration heat exchanger is intended to extract heat at at least one member by heat exchange with the working fluid circulating in the working circuit;

a coolant circuit supplies cooling fluid first of all to the first cooling heat exchanger in series in the in the direction of circulation of the working fluid, and then the second cooling heat exchanger in series in the direction of circulation of the working fluid is supplied with cooling fluid that has passed through the first cooling heat exchanger, or the coolant circuit supplies cooling fluid first of all to the second cooling heat exchanger in series in the direction of circulation of the working fluid, the first cooling heat exchanger in series in the direction of circulation of the working fluid being supplied with cooling fluid that has passed through the second cooling heat exchanger;

the cooling fluid effects a single passage through said cooling heat exchangers such that there are not several simultaneous passages of the cooling fluid through the cooling heat exchangers at different temperatures or under different thermodynamic conditions; and the working fluid to be cooled and a relatively colder cooling fluid pass in countercurrent directions of circulation through each of the cooling heat exchangers, wherein:

the two cooling heat exchangers each have an elongate shape extending in a respective longitudinal direction;

each cooling heat exchanger comprises an inlet for working gas to be cooled and an outlet for cooled working gas that are disposed respectively at two longitudinal ends; and the two cooling heat exchangers are arranged inversely with respect to one another such that respective longitudinal directions of the two cooling heat exchangers are parallel or substantially parallel and directions of circulation of the working fluid in said cooling heat exchangers are opposite to one another.

2. The device of claim 1, wherein the two cooling heat exchangers are situated adjacently and spaced apart by a distance of between 50 and 500 mm.

3. A system for refrigeration and/or liquefaction of a flow of user fluid, comprising the refrigeration device of claim 1, the system comprising at least one tank of user fluid, and a duct for circulation of said flow of user fluid in the cooling exchanger.

4. The system of claim 3, wherein the compression mechanism comprises two or more compressors and at least one drive motor for rotating the compressor(s) and comprising a rotary drive shaft, the compressors being driven in rotation by the respective rotary shaft(s), the mechanism for expanding the working fluid comprising at least one rotary turbine that rotates conjointly with a shaft of one of the drive motors of at least one compressor, and in that a refrigeration capacity of the refrigeration device is variable and controlled by a controller that regulates a speed of rotation of the drive motor(s).

5. A low-temperature refrigeration device for refrigeration at a temperature of between minus 100 degrees centigrade and minus 273 degrees centigrade, comprising a working circuit and a refrigeration heat exchanger, wherein:

the working circuit forms a loop and contains a working fluid;

the working circuit forms a cycle that comprises, in series: a compression mechanism for compressing the working fluid, a cooling mechanism for cooling the working fluid, an expanding mechanism for expanding the working fluid, and a heating mechanism for heating the working fluid;

the compression mechanism comprises two separate compressors;

the cooling mechanism comprises two cooling heat exchangers that are disposed respectively at the outlets of the two compressors and ensure heat exchange between the working fluid and a cooling fluid;

each cooling heat exchanger comprises an inlet for cooling fluid and an outlet for cooling fluid;

the outlet for cooling fluid of one of the two cooling heat exchangers is connected to the inlet for cooling fluid of the other cooling heat exchanger such that the flow of cooling fluid passing through one of the cooling heat exchangers has already circulated in the other cooling heat exchanger;

the two compressors are disposed in series in the working circuit;

the refrigeration heat exchanger is intended to extract heat at at least one member by heat exchange with the working fluid circulating in the working circuit;

a coolant circuit supplies cooling fluid first of all to the first cooling heat exchanger in series in the in the direction of circulation of the working fluid, and then the second cooling heat exchanger in series in the direction of circulation of the working fluid is supplied with cooling fluid that has passed through the first cooling heat exchanger, or the coolant circuit supplies cooling fluid first of all to the second cooling heat exchanger in series in the direction of circulation of the working fluid, the first cooling heat exchanger in series in the direction of circulation of the working fluid being supplied with cooling fluid that has passed through the second cooling heat exchanger;

the cooling fluid effects a single passage through said cooling heat exchangers such that there are not several simultaneous passages of the cooling fluid through the cooling heat exchangers at different temperatures or under different thermodynamic conditions; and the working fluid to be cooled and a relatively colder cooling fluid pass in countercurrent directions of circulation through each of the cooling heat exchangers, wherein the two cooling heat exchangers are incorporated into one and the same casing comprising two separate passages for the circulation of the working fluid, said two passages being in heat exchange respectively with two portions in series of one and the same circulation channel of the cooling fluid circuit.

6. A system for refrigeration and/or liquefaction of a flow of user fluid, comprising the refrigeration device of claim 5, the system comprising at least one tank of user fluid, and a duct for circulation of said flow of user fluid in the cooling exchanger.

* * * * *